US005417773A

United States Patent [19]

Nakayama et al.

[11] Patent Number: 5,417,773

[45] Date of Patent: May 23, 1995

[54] METHOD FOR PRODUCING RARE EARTH ALLOY MAGNET POWDER

[75] Inventors: Ryoji Nakayama; Takuo Takeshita; Yoshinari Ishii; Tamotsu Ogawa, all of Omiya, Japan

[73] Assignee: Mitsubishi Materials Corporation, Tokyo, Japan

[21] Appl. No.: 319,465

[22] Filed: Oct. 6, 1994

Related U.S. Application Data

[63] Continuation of Ser. No. 980,483, Nov. 23, 1992, abandoned.

[30] Foreign Application Priority Data

Dec. 10, 1991 [JP] Japan ..... 3-349934

[51] Int. Cl.[6] ..... H01F 1/057

[52] U.S. Cl. ..... 148/101; 148/122

[58] Field of Search ..... 148/101, 102, 103, 104, 148/105, 122; 241/1, 18, 23, 24, 29, 65

[56] References Cited

U.S. PATENT DOCUMENTS 4,981,532 1/1991 Takeshita et al. ..... 148/302

FOREIGN PATENT DOCUMENTS 0304054 8/1988 European Pat. Off. .

0411571 7/1990 European Pat. Off. .

*Primary Examiner*—John P. Sheehan

*Attorney, Agent, or Firm*—Scully, Scott, Murphy & Presser

[57] ABSTRACT

The present invention provides a method for producing a rare earth alloy magnet powder exhibiting stable and superior magnetic properties using hydrogenation followed by dehydrogenation. In a method for producing a rare earth alloy magnet powder wherein a homogenized rare earth alloy magnet alloy material is subjected to hydrogenation at a temperature in a range between 750° C. and 950° C., followed by dehydrogenation at a temperature in a range between 750° C. and 950° C.; cooled; and crushed, both the hydrogenation and the dehydrogenation are carried out in a vacuum tube furnace; and the alloy material in the dehydrogenation step maintains a temperature drop of at most 50° C. due to an endothermic reaction which occurs during the dehydrogenation step.

2 Claims, 1 Drawing Sheet

METHOD FOR PRODUCING RARE EARTH ALLOY MAGNET POWDER

This is a continuation of application Ser. No. 07/980,483 filed on Nov. 23, 1992, now abandoned.

BACKGROUND OF THE INVENTION

1. Field of the Invention

The present invention relates to a method for producing a rare earth alloy magnet powder which exhibits stable and superior magnetic properties.

2. Related Art

Heretofore, there has been well known a method for producing a rare earth alloy magnet powder comprising:

a rare earth element inclusive of yttrium (Y) (which will be hereinafter represented by "R");

iron (Fe) which may be partially substituted with cobalt (Co) (which will be hereinafter represented by "T"); and boron (B).

The conventional method as disclosed in copending U.S. Patent Application Ser. No. 560,594 and U.S. Pat. No. 4,981,532 comprises the successive steps of:

melting and casting a R-T-B alloy ("R", "T" and "B" are as defined above) in which "R", "T" and boron (B) are included as main ingredients to form an ingot;

subjecting the ingot to a homogenization treatment while the temperature of the ingot is maintained from 600° C. to 1200° C.;

placing the homogenized ingot and a regenerative material (heat-storage material) in a heat treating furnace;

occluding hydrogen into the homogenized ingot in the heat treating furnace kept under a hydrogen atmosphere by heating the furnace from room temperature to 500° C., followed by maintaining the furnace at a temperature in a range between 750° C. and 950° C. to form a hydrogen-occluded ingot, wherein a phase transformation occurs in the ingot;

subjecting the hydrogen-occluded ingot to a dehydrogenation while maintaining the furnace in a vacuum at a temperature in a range between 750° C. and 950° C., wherein a phase transformation occurs in the ingot; and cooling and crushing the dehydrogenated ingot to obtain a R-T-B alloy magnet powder.

In general, the phase transformation which occurs during the dehydrogenation is an endothermic reaction, as described in copending U.S. Patent Application Ser. No. 560,594, so that the temperature of the ingot is lowered, whereby thus obtained R-T-B alloy magnet powder suffers degradation in magnetic properties. In order to avoid this disadvantage, a regenerative material is employed to compensate for the temperature drop due to the endothermic reaction in the conventional art as described above.

However, the conventional art using a regenerative material has the following drawbacks:

(a) It is difficult for the regenerative material to contact all ingots. The ingots in contact with the regenerative material can be maintained at a desired temperature, while the ingots away from the regenerative material cannot avoid reducing the temperature, leading to degraded magnetic properties of the magnet powder.

(b) A large heat treating furnace with a large volume is needed in order to place the regenerative material therein. With a large volume of the heat treating furnace, in addition to the length of time required for changing the atmosphere from a hydrogen atmosphere to a vacuum, the scale of the facility for processing a given quantity of ingots becomes large, leading to poor productivity.

(c) The treated ingots in the furnace need to be separated from the regenerative material before the crushing step. During the separation of the ingots from the regenerative material, a part of the regenerative material may contaminate the separated ingot, causing a degradation in magnetic properties of the final product.

SUMMARY OF THE INVENTION

It is therefore an object of the present invention to provide a method for producing a rare earth alloy magnet powder exhibiting stable and superior magnetic properties, within a small space with an efficient change from a hydrogen atmosphere to a vacuum in the absence of regenerative materials.

According to an aspect of the present invention, there is provided a method for producing a rare earth alloy magnet powder which includes a ferromagnetic compound, comprising the steps of:

(a) preparing a rare earth alloy material represented by R-T-B alloy, wherein R is a rare earth element inclusive of yttrium (Y) ; T is iron (Fe) which may be partially substituted with cobalt (Co); and B is boron (B);

(b) subsequently subjecting the alloy material to a homogenization treatment while maintaining the alloy at a temperature in a range between 600° C. and 1200° C. to form a homogenized alloy;

(c) preparing a vacuum tube furnace;

(d) subsequently placing the homogenized alloy in the vacuum tube furnace;

(e) subsequently occluding hydrogen into the homogenized alloy in the vacuum tube furnace by heating the furnace from room temperature to 500° C. followed by maintaining the furnace at a temperature in a range between 750° C. and 950° C. to form a hydrogen-occluded alloy;

(f) subsequently subjecting the hydrogen-occluded alloy to dehydrogenation while maintaining the alloy, placed in the furnace in a vacuum, at a temperature in a range between 750° C. and 950° C. to form a dehydrogenated alloy, wherein the alloy maintains a temperature drop of at most 50° C. due to an endothermic reaction occurring during the dehydrogenation; and (g) cooling and crushing the dehydrogenated alloy to obtain a R-T-B rare earth alloy magnet powder comprising particles, each particle having an aggregated structure of fine recrystallized grains of the ferromagnetic compound.

DETAILED DESCRIPTION OF THE INVENTION

Figure 1:
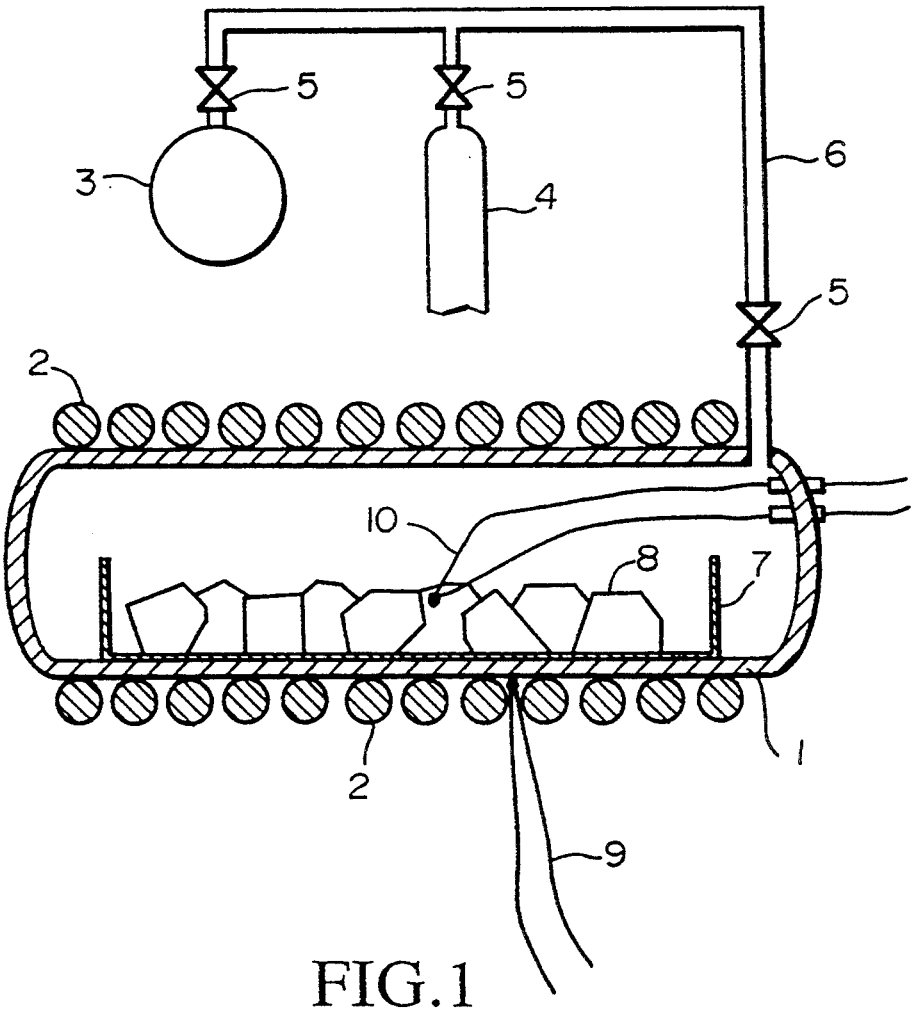
FIG. 1 is a schematic cross sectional view showing a vacuum tube furnace employed in the present invention.

The results of extensive study directed towards a production of a rare earth alloy magnet powder exhibiting stable and superior magnetic properties, within a small space with an efficient change from a hydrogen atmosphere to a vacuum in the absence of regenerative materials have revealed the following:

(a) When a vacuum tube furnace is employed as the heat treating furnace, the control of the object (alloy) temperature can be easily carried out due to a superior temperature-response of the alloy in the vacuum tube furnace. Therefore, during the dehydrogenation step described above, the temperature drop in the alloy can be controlled without the use of regenerative materials.

(b) Although the dehydrogenation step is conducted in a vacuum, and heat absorption due to the endothermic reaction occurs by the ingot being dehydrogenated, the vacuum tube furnace provides efficient radiant heat and is able to prevent an excessive drop in the ingot temperature to within 50° C. and more preferably within 20° C., thereby preventing the degradation in magnetic properties of the final product (magnet powder).

The invention will now be described with reference to the preferred Examples of the method for producing a rare earth alloy magnet powder according to the present invention. The preferred Examples are given simply by way of illustration and cannot in any way limit the scope of the invention.

Examples

A vacuum tube furnace employed in the present invention comprises a tube 1 made of stainless steel and an adjustable heater 2 mounted around the outer peripheral surface of the tube 1, as shown in FIG. 1.

When an ingot fragment 8 which is obtained by crushing a homogenized ingot is hydrogen-occluded, the temperature of the ingot fragment 8 is increased due to an exothermic reaction in the hydrogenation step defined as step (e). In order to control the furnace temperature accurately, the temperature adjustment of the heater 2 is carried out with a thermocouple 9 mounted on the outer surface of the tube 1.

However, the temperature drop of the ingot fragments 8 in the dehydrogenation step (step (f)) cannot be accurately measured by the thermocouple 9. Therefore, the control for preventing the temperature drop of the ingot fragments 8 in the step (f) is carried out by adjusting the output of the heater 2, in accordance with the measured signals of a heater 10 which is in contact with the ingot fragments 8. A vacuum pump 3 and a hydrogen cylinder 4 are connected to the tube 1 via a pipe 6. The inner space of the tube 1 can be maintained in either a hydrogen atmosphere or a vacuum using a switching valve 5.

It is possible to control the temperature drop of the ingot fragments 8 during the dehydrogenation step (step (f) ) by setting an appropriate temperature pattern of the thermocouple 9 mounted on the outer surface of the tube 1, for example, so that the temperature of the heater 2 is raised by an amount of $+\alpha$ C. before and after the step (f) . The value of $+\alpha$° C. is preferably determined, based on the temperature of a thermocouple 10 contacting with the ingot fragments 8, since the value of $+\alpha$ C. largely depends on the size of the ingot fragments 8, the initiation temperature of the alehydrogenation step (step (f)), alloy composition, and the like. Furthermore, a plurality of the thermocouples 10 may be arranged on the ingot fragments 8 so as to secure accurate temperature adjustment of the heater 2.

In addition, the magnet powder obtained by the method according to the present invention may be subjected to a heat treatment at a temperature in a range between 300° C. and 1000° C., as necessary, in order to improve the magnetic properties of the same.

Examples 1 to 7

As a starting material, an alloy material was prepared, having a composition comprising: 12.6 atomic percent of neodymium (Nd); 17.2 atomic percent of cobalt (Co); 6.5 atomic percent of boron (B); 0.3 atomic percent of gallium (Ga); 0.1 atomic percent of zirconium (Zr); and the remainder of iron (Fe) and unavoidable impurities. The alloy material was melted by induction melting furnace and cast into an alloy ingot. The alloy ingot was subjected to a homogenization treatment while the ingot was maintained for 20 hours under an argon atmosphere at 1200° C. to form a homogenized ingot. The homogenized ingot was crushed using a jaw crusher into ingot fragments 8, each ingot fragment having a particle size of approximately 10 mm to 15 mm.

The ingot fragments 8 were subjected to a first hydrogenation as follows:

The ingot fragments 8 were placed on a board 7, as shown in FIG. 1, and fed in the tube 1 made of stainless steel of the vacuum tube furnace, and the vacuum tube furnace was evacuated using a vacuum device 3. Hydrogen gas at 1 atm was then introduced into the furnace by switching the valve 5. The temperature was elevated from room temperature to the temperature shown as the first hydrogenation temperature in Table 1 and maintained at the elevated temperature for 1 hour using the heater 2, while the pressure of hydrogen gas was maintained at 1 atm, to form first hydrogen-occluded ingot fragments.

The first hydrogen-occluded ingot fragments were subjected to a second hydrogenation while maintaining the furnace at the temperature shown as the second hydrogenation temperature in Table 1 for 3 hours to form the second hydrogen-occluded ingot fragments.

Subsequently, the second hydrogen-occluded ingot fragments were subjected to a dehydrogenation as follows:

After the temperature of the furnace was elevated to the temperature shown as the dehydrogenation temperature in Table 1, the hydrogen in the furnace was evacuated to a vacuum of $1\times10^{-1}$ Torr or higher vacuum using the vacuum device 3, while the heater 2 was adjusted so that the temperature of the thermocouple 10 arranged on the ingot fragments exhibited a temperature drop within the range as shown in Table 1.

Subsequently, an argon gas was introduced thereinto until the pressure reached 1 atm, and rapid quenching of the dehydrogenated ingot fragments was effected, thus obtaining the final ingot fragments according to the present invention (seven ingot fragments according to the present invention).

For comparison purposes, comparative final ingot fragments (two comparative ingot fragments) were prepared by repeating the same procedures as described above, except that the temperature drop during the dehydrogenation step was outside of the claimed range, as shown in Table 2. In addition, a conventional final ingot fragment (one conventional ingot fragment) was prepared by repeating the same procedures as described above, except that a conventional vacuum box furnace with a regenerative material was used instead of the vacuum tube furnace, wherein an ingot fragment was arranged apart from the regenerative material.

Each of the final ingot fragments according to the present invention, the comparative final ingot fragments, and the conventional final ingot fragment was individually broken into pieces having particle sizes of 400 μm or less to produce sample powders of: the rare earth alloy magnet powders according to the present invention; the comparative magnet powders; and the conventional magnet powder. Each of the magnet powders described above was mixed with 2.5% by weight of epoxy resin, subjected to a compression molding in a lateral magnetic field of 20 KOe, and then subjected to a thermo-setting treatment for 3 hours at 150° C., thus obtaining an anisotropic bond magnet having a density of 5.95 to 6.00 g/cm$^3$ of bond magnets Nos. 1 to 7 according to the present invention, comparative bond magnets Nos. 1 and 2, or conventional bond magnet No. 1. These bond magnets had the magnetic properties as shown in Tables 1 and 2.

TABLE 1

| Sample | First hydrogenation temperature (°C.) | Second hydrogenation temperature (°C.) | Dehydrogenation temperature (°C.) | Temperature drop during step (f) (°C.) | Magnetic properties of bonded magnet: Residual magnetic flux density Br (KG) | Coercivity iHc (KOe) | Maximum energy product (BH) max (MGOe) |
|---|---|---|---|---|---|---|---|
| Bond magnets of the present invention | | | | | | | |
| No. 1 | 250 | 750 | 760 | −2 | 8.8 | 15.2 | 17.5 |
| No. 2 | 300 | 800 | 800 | −5 | 9.0 | 15.0 | 18.1 |
| No. 3 | 300 | 850 | 850 | −2 | 9.2 | 14.5 | 1B.7 |
| No. 4 | 300 | 850 | 850 | −10 | 9.1 | 14.8 | 18.4 |
| No. 5 | 300 | 850 | 840 | −30 | 8.8 | 13.6 | 17.0 |
| No. 6 | 300 | 880 | 880 | −50 | 8.7 | 13.4 | 16.2 |
| No. 7 | 400 | 950 | 950 | −20 | 9.1 | 13.0 | 16.8 |

TABLE 2

| Sample | First hydrogenation temperature (°C.) | Second hydrogenation temperature (°C.) | Dehydrogenation temperature (°C.) | Temperature drop during step (f) (°C.) | Magnetic properties of bonded magnet: Residual magnetic flux density Br (KG) | Coercivity iHc (KOe) | Maximum energy product (BH) max (MGOe) |
|---|---|---|---|---|---|---|---|
| Comparative bond magnets | | | | | | | |
| No. 1 | 300 | 850 | 850 | −62 | 8.5 | 10.1 | 13.2 |
| No. 2 | 300 | 800 | 820 | −106 | 6.5 | 6.8 | 5.7 |
| Conventional bond magnet | | | | | | | |
| No. 1 | 300 | 850 | 850 | −123 | 8.4 | 9.6 | 12.5 |

From the results shown in Tables 1 and 2, each of the rare earth alloy magnet powders, using the method according to the present invention wherein a vacuum tube furnace is employed as a heat treating furnace and wherein the ingot in the dehydrogenation step (step (f)) maintains a temperature drop of at most 50° C. due to an endothermic reaction during the step (f), is superior in the magnetic properties, as compared with not only the comparative rare earth alloy magnet powders produced by the comparative method wherein the temperature drop of the ingot in the dehydrogenation step (step (f)) due to the endothermic reaction is not less than 50° C. but also the conventional rare earth alloy magnet powder produced by the conventional method wherein the conventional regenerative material is employed so as to control the temperature drop during the dehydrogenation step (step (f)).

According to the method of the present invention, a rare earth alloy magnet powder exhibiting stable and superior magnetic properties can be efficiently produced in the absence of regenerative materials, leading to high productivity from an industrial point of view.

What is claimed is:

1. A method for producing a rare earth alloy magnetic powder which includes a ferromagnetic compound, comprising the steps of:

(a) preparing a rare earth alloy material represented by R-T-B alloy, wherein R is at least one rare earth element inclusive of yttrium (Y); T is iron (Fe) which may be partially substituted with cobalt (Co); and B is boron (B);

(b) subsequently subjecting the alloy material to a homogenization treatment while maintaining the alloy at a temperature in a range between 600° C. and 1200° C. to form a homogenized alloy ingot;

(c) crushing the homogenized alloy ingot into homogenized alloy ingot fragments and placing the ingot fragments, in the absence of a regenerative material, in a vacuum tube furnace having heater disposed therearound;

(d) subsequently introducing hydrogen into the vacuum tube furnace and subjecting the homogenized alloy in the vacuum tube furnace to hydrogenation, wherein said hydrogenation includes occluding hydrogen into the homogenized alloy while heating the furnace from room temperature to 500° C. followed by elevating and maintaining the furnace temperature between 750° C. and 950° C. by controlling said heater using a first temperature detecting means attached to an outer surface of said vacuum tube furnace to form a hydrogenated alloy;

(e) subsequently subjecting the hydrogenated alloy to dehydrogenation while maintaining the alloy, placed in the vacuum tube furnace, at a temperature in a range between 750° C. and 950° C. to form a dehydrogenated alloy, wherein said vacuum tube furnace substantially provides radiant heat and limits a temperature drop in the alloy due to an endothermic reaction occurring during the dehydrogenation to at most 50° C., and wherein the maintaining of the temperature is carried out by controlling said heater using a second temperature detecting means held in contact with the ingot fragments;

(f) cooling and crushing the dehydrogenated alloy to obtain a R-T-B rare earth alloy magnet powder comprising particles, each particle having an aggregated structure of fine recrystallized grains of the ferromagnetic compound.

2. A method for producing a rare earth alloy magnet powder as recited in claim 1, wherein the alloy in the step (f) maintains the temperature drop of at most 20° C. due to the endothermic reaction occurring during the step (f).

* * * * *

UNITED STATES PATENT AND TRADEMARK OFFICE

CERTIFICATE OF CORRECTION

PATENT NO. : 5,417,773

DATED : May 23, 1995

INVENTOR(S) : Rjoji Nakayama, et al.

It is certified that error appears in the above-indentified patent and that said Letters Patent is hereby corrected as shown below:

Column 3, lines 59 & 63: " +αC." should read -- +α°C. --

Column 3, line 65: " alehydrogenation " should read -- dehydrogenation --

Column 6, line 34, Table 1: " 1B.7 " should read -- 18.7 --

Signed and Sealed this

Fourteenth Day of May, 1996

Bruce Lehman

BRUCE LEHMAN

*Commissioner of Patents and Trademarks*

*Attest:*

*Attesting Officer*